United States Patent [19]

Williams et al.

[11] 4,331,054

[45] May 25, 1982

[54] ELECTRIC GEL SLICER

[75] Inventors: Vincent P. Williams, Canogh Park; Shelly S. Sandifer, Simi Valley, both of Calif.

[73] Assignee: The United States of America as represented by the Secretary of the Department of Health and Human Services, Washington, D.C.

[21] Appl. No.: 174,239

[22] Filed: Jul. 31, 1980

[51] Int. Cl.[3] ..... B26D 3/16; B26D 5/22

[52] U.S. Cl. ..... 83/224; 83/275; 83/278; 83/437; 83/448; 83/915.5

[58] Field of Search ..... 83/278, 275, 587, 586, 83/223, 224, 437, 915.5, 448, 449

[56] References Cited

U.S. PATENT DOCUMENTS

| | | | |
|---|---|---|---|
| 1,395,655 | 11/1921 | Porz | 83/278 X |
| 1,798,038 | 3/1931 | Scott et al. | 83/437 |
| 1,809,764 | 6/1931 | Trunz | 83/437 X |
| 2,186,878 | 10/1938 | Ordman . | |
| 3,091,269 | 5/1963 | Burns et al. | 83/437 X |
| 3,420,130 | 2/1966 | Farquhar et al. . | |
| 3,496,819 | 2/1970 | Blum | 83/587 X |
| 3,807,604 | 4/1974 | Schaffer et al. . | |
| 3,924,499 | 12/1975 | Dechambre et al. | 83/275 X |
| 4,152,963 | 5/1979 | Romanik et al. | 83/437 X |

*Primary Examiner*—Frank T. Yost

*Attorney, Agent, or Firm*—Browdy and Neimark

[57] ABSTRACT

A gel slicer consisting of a support with a gel guide trough and a feed screw journalled parallel to the trough. A feed plunger assembly is threadedly engaged on the feed screw and has a plunger portion slidably engaged in the trough. The feed screw is intermittently driven by a power shaft via selectable identical-diameter gear discs with different-length tooth configuration for varying the increment of feed of the gel per revolution of the power shaft. The gear discs have smooth peripheral portions providing dwell periods of the feed screw. A pivoted transverse cutting blade is spring-biased toward cutting position over the trough and is held elevated by a follower lug engaging a cam on the power shaft, the cam having a blade-release notch. The cam is synchronized to release the cutting blade during the dwell period of the feed screw. Thus, the thickness of the slice depends on the amount of teeth on that gear disc which is selected to drive the feed screw. The selected gear provides desired incremental steps of longitudinal movement of the gel.

14 Claims, 8 Drawing Figures

ELECTRIC GEL SLICER

The invention described herein was made in the course of work under a grant or award from the Department of Health, Education, and Welfare.

FIELD OF THE INVENTION

This invention relates to material slicing machines, and more particularly to apparatus for cutting uniform slices of gel material.

BACKGROUND OF THE INVENTION

In typical procedures for studying gel materials, such materials have been frozen, and then sliced into uniform segments for use as samples for study. Previously employed gel slicing devices have not been able to produce satisfactorily uniform slices, are slow in operation, and been limited to slices either of only one thickness or to arrangements wherein it is very difficult to vary the slice thickness and at the same time maintain uniformity of the adjusted slice thickness. In most of the prior gel slicing devices the apparatus is hand-operated, limiting the slicing speed and making it difficult to insure slicing accuracy. Although feed screws have been employed for advancing the gel material into slicing position, there has not been accurate coordination between the operation of the feed screw and the slice-cutting blade, so that it has been difficult to obtain adequate uniformity of slice thickness with reasonably rapid slicing action.

Accordingly, there is a definite need for an automated gel slicing apparatus wherein the slice thickness is accurately maintained, wherein it is easy to load the apparatus with gel material to be sliced, wherein the apparatus can be easily adjusted to obtain a desired slice thickness, and wherein there is accurate and reliable coordination between the feed screw and the slice cutting blade in any one of the adjusted slice thickness conditions.

A number of commercial gel slicers are presently available, but these all suffer from one or more of the deficiencies mentioned above. These include the Mickle Gel Slicer (Brinkman Instruments, Inc.); the Lateral Gel Slicer (Ames Company, Miles Division of Miles Laboratories); the Macrotome GTS (Linca Lamon Instrumentation Co., Ltd.); and the Bio-Rad Gel Slicer Model 190 and Bio-Rad Electric Gel Slicer Model 195 (Bio-Rad Laboratories). Patented devices, also deficient in one or more of the afore-mentioned ways, are shown in Schaffer et al U.S. Pat. No. 3,807,604; Farquhar et al U.S. Pat. No. 3,420,130; Blum U.S. Pat. No. 3,496,819 and Ordman U.S. Pat. No. 2,186,878.

SUMMARY OF THE INVENTION

Accordingly, an object of the invention is to overcome the deficiencies and disadvantages of the previously known gel slicers.

Another object is to provide for improved gel slicing; and yet another object is to provide a novel and improved gel slicing device.

A further object of the invention is to provide an improved motor-driven gel slicer which is easy to operate, which may be readily adjusted to obtain different slice thicknesses, which is easy to load with gel material to be sliced, and which maintains accurate uniformity of slice thickness in any of its adjusted states.

A still further object of the invention is to provide an improved automated apparatus for slicing gel material uniformly and at a rapid rate, the apparatus employing a feed screw for advancing the material and change gearing for varying the amount of advance per slicing step, and being provided with a pivoted cutting blade whose action is accurately synchronized with the operation of the feed screw, the blade being held in a raised inactive position while the material is advanced for cutting, the advance being halted in a dwell state when the required amount of gel material is in position for slicing, and the blade being automatically activated through a cutting stroke and then returned to its raised position while the feed screw is still in its dwell state.

A still further object of the invention is to provide an improved electrically operated automated gel slicer which advances gel material in steps for slicing and which may be readily adjusted to provide steps of various lengths for obtaining slices of different desired thicknesses, which is easy to load with gel material to be sliced, and which can receive different lengths of such gel material and can be readily set to advance any of such different lengths for immediate slicing after the material has been placed in the device.

BRIEF DESCRIPTION OF THE DRAWINGS

Further objects and advantages of the invention will become apparent from the following description and claims, and from the accompanying drawings, wherein:

DESCRIPTION OF A PREFERRED EMBODIMENT

Figure 1:
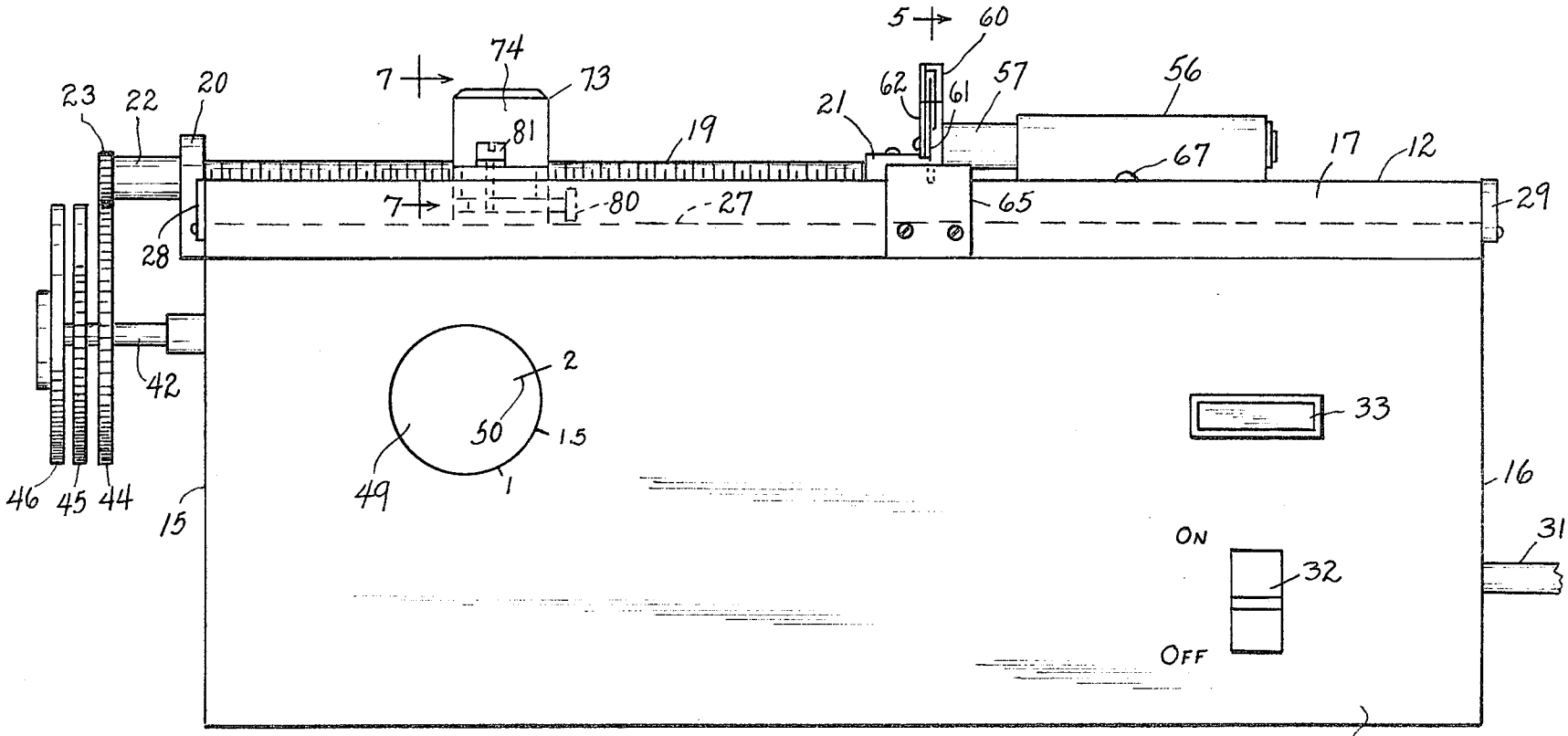
FIG. 1 is a front elevational view of a typical improved electric gel slicer constructed in accordance with the present invention.
Figure 2:
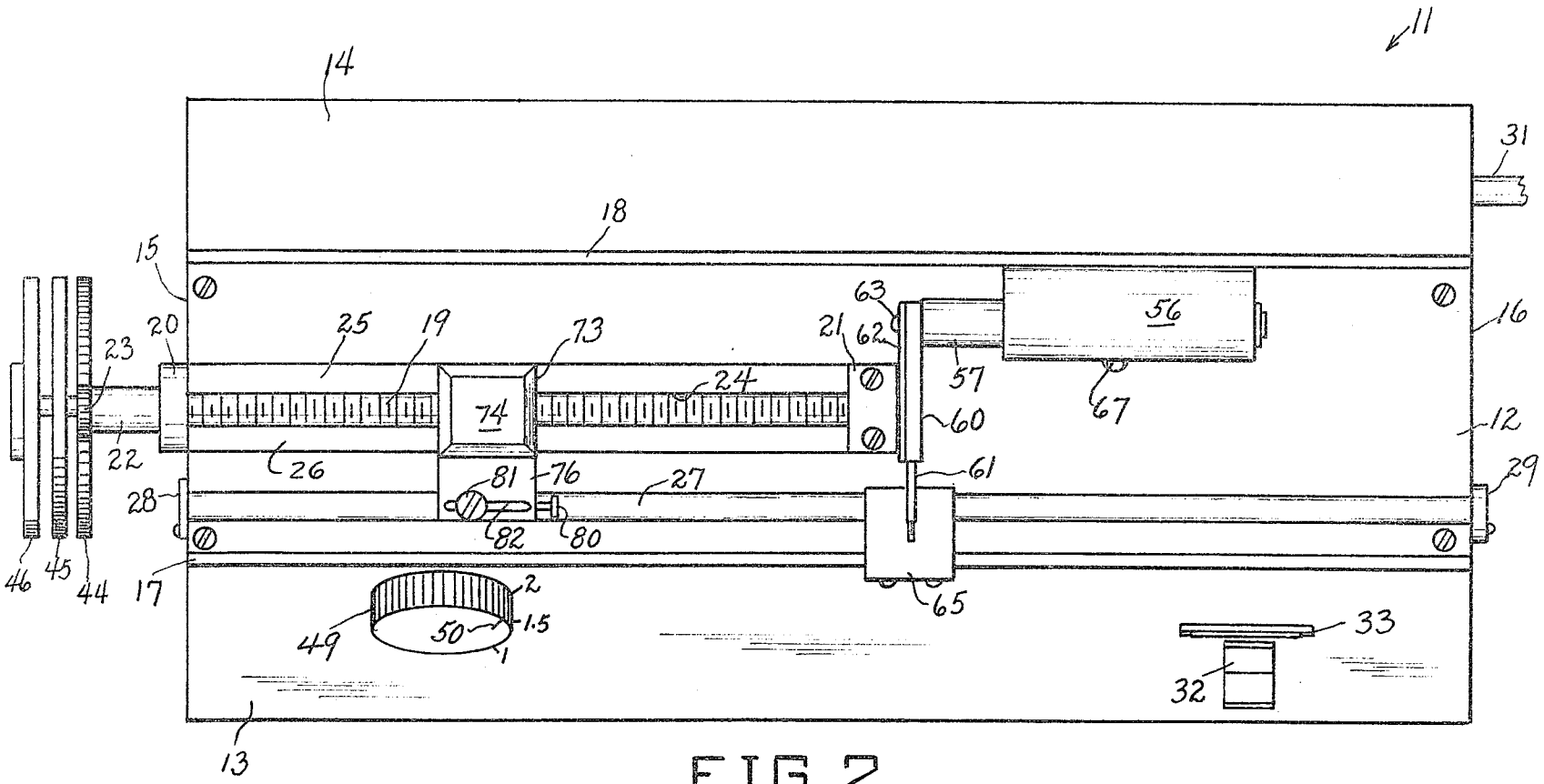
FIG. 2 is a top plan view of the gel slicer of FIG. 1.

Referring to the drawings, 11 generally designates a typical embodiment of an electric gel slicer according to the present invention. This embodiment is particularly adapted for cutting cylindrical bodies of gels, such as polyacrylamide gel, into uniform segments at temperatures as low as 0° C. While the gel may be handled and cut at a variety of temperatures, it will be understood that frozen gels are popularly used because they are more easily handled. The typical embodiment of the gel slicer described herein may be used to cut polyacrylamide gels up to approximately 160 mm long and 6 mm in diameter, having monomer concentrations of 5 to 10% acrylamide.

The gel slicer 11 comprises a main housing having an elongated top wall 12, a downwardly and outwardly inclined front wall 13, a downwardly and outwardly inclined rear wall 14, and opposite vertical end walls 15 and 16. The front and rear walls 13 and 14 have respective short top end portions 17 and 18. A feed screw 19 is longitudinally journalled in the leftward portion of top wall 12, as viewed in FIG. 1, being journalled in respective leftward and rightward bearing blocks 20 and 21, and having a leftwardly projecting shaft portion 22 provided with a pinion gear 23. Top wall 12 is formed with a longitudinal groove 24 (see FIG. 7) conformably rotatably receiving the lower half of screw 19, and with flat-bottomed longitudinal guide recesses 25, 26 adjacent the opposite sides of said screw. Top wall 12 is further formed with a longitudinal gel-receiving trough 27 laterally spaced from screw 19 and extending for the full length of the top wall. A cover plate 28 is secured to end wall 15, overlying the left end of trough 27, and a rotatable cover disc 29 is pivotally secured to end wall 16, normally overlying the right end of trough 27 but being rotatable at times to uncover said right end for removing gel slices from the trough.

Rigidly mounted within the main housing is an electric motor 30, similar to Bodine Model K-722, 115 volts, 13 r.p.m., non-synchronous type, connected to a line cord 31 via a main switch 32 mounted on front wall 13. An indicating lamp assembly 33 is mounted on said front wall 13 above the main switch 32, and is suitably connected in parallel with the motor to indicate its energized state. Motor 30 has an output shaft 35 provided with a drive gear 36 meshing with a driven gear 37 (see FIG. 4) rigidly mounted on a longitudinal hollow shaft 38 journalled above motor 30 in spaced bearing blocks 39 and 40 secured to and depending from the bottom surface of top wall 12.

Figure 4:
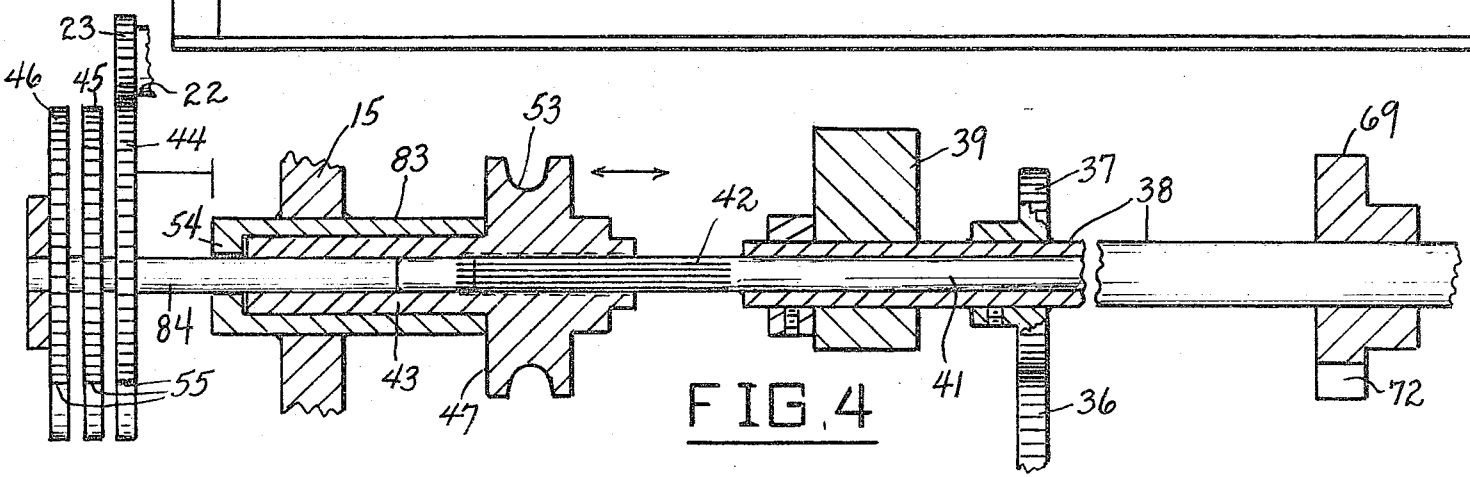
FIG. 4 is an enlarged fragmentary longitudinal vertical cross-sectional view taken substantially on line 4—4 of FIG. 3.

A shaft 41 is rigidly secured in hollow shaft 38 and is thus drivingly coupled thereto. Shaft 41 has a splined leftward portion 42, as shown in FIG. 4, which is slidably keyed in a peripherally groove spool member 47 having an axial sleeve portion 43. Sleeve portion 43 is slidably and rotatably supported in a cup-like bearing sleeve 83 rigidly secured in end wall 15, and has a shaft 84 rigidly secured axially therein, which in turn has rigidly mounted on its outer portion three respective similarly-sized gears 44, 45 and 46, each being meshingly engageable with pinion gear 23 in a respective longitudinally adjusted position of movable shaft 84. The peripherally-grooved spool member 47 is splined on shaft portion 42 and is located so as to substantially abut the right end of bearing sleeve member 83 when the innermost gear 44 is fully meshed with pinion gear 23. The left end wall 54 of sleeve member 83 is preferably located so that gear 44 is substantially in abutment therewith when outermost gear 46 is fully meshed with said pinion gear 23. Shaft 84 may be moved to an intermediate position wherein the middle gear 45 is meshed with pinion gear 23.

Figure 3:
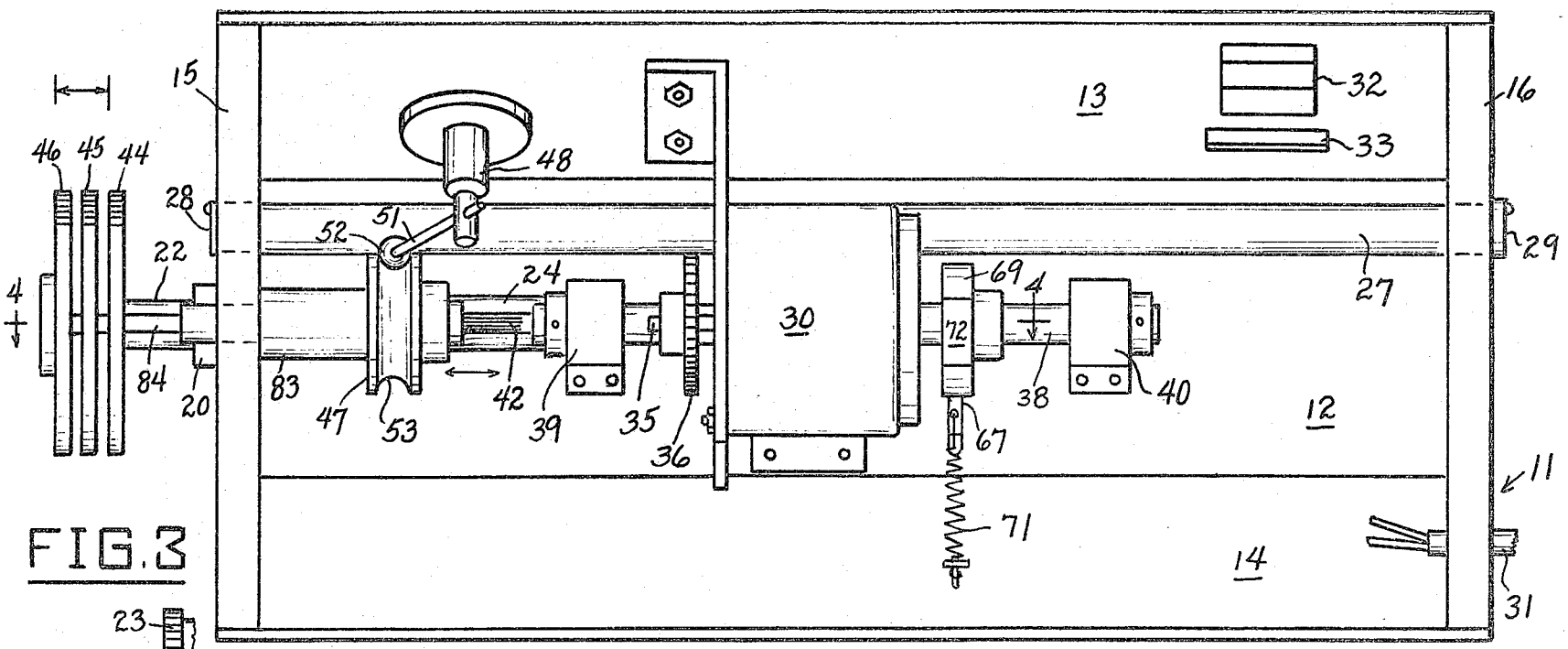
FIG. 3 is a bottom plan view of the gel slicer of FIG. 1.

As shown in FIG. 3, a gear-shifting shaft 48 is rotatably mounted in front wall 13 and is provided with an outer operating knob 49 with a shaft position-indicating marker 50. The front wall 13 has respective slice thickness markings adjacent the periphery of the knob, corresponding to the three gear-meshing positions of shaft 48. Rigidly secured to the inner end portion of shaft 48 is an arm 51 extending toward the periphery of spool member 47 and provided at its end with a coupling ball 52 drivingly engaging in the peripheral groove 53 of the spool member 47 and acting to shift the spool member axially responsive to rotation of knob 49. The three marked panel positions for index marker 50 correspond to the respective meshed positions of gears 44, 45 and 46 with pinion gear 23, and the corresponding gel slice thicknesses obtainable therefrom.

The three slice thickness-selecting gears 44, 45 and 46 are identical in diameter but have decreasing numbers of teeth, corresponding to decreasing discrete numbers of revolutions of feed screw 19 generated per revolution of driving shaft 41. Thus, in the setting shown in FIG. 1, the pinion gear 23 is in mesh with the teeth of gear 44, having the maximum number of gear teeth, and providing a number of revolutions of screw 19 corresponding to a feed distance of 2 mm. Intermediate gear 45 has a lesser number of teeth, providing a feed distance of 1.5 mm. End gear 46 has a still smaller number of teeth, providing a feed distance of 1 mm. The remainders of the peripheries of the gears are smooth, namely, toothless, and are non-driving relative to the feed screw, providing dwell periods for the feed screw.

Figure 5:
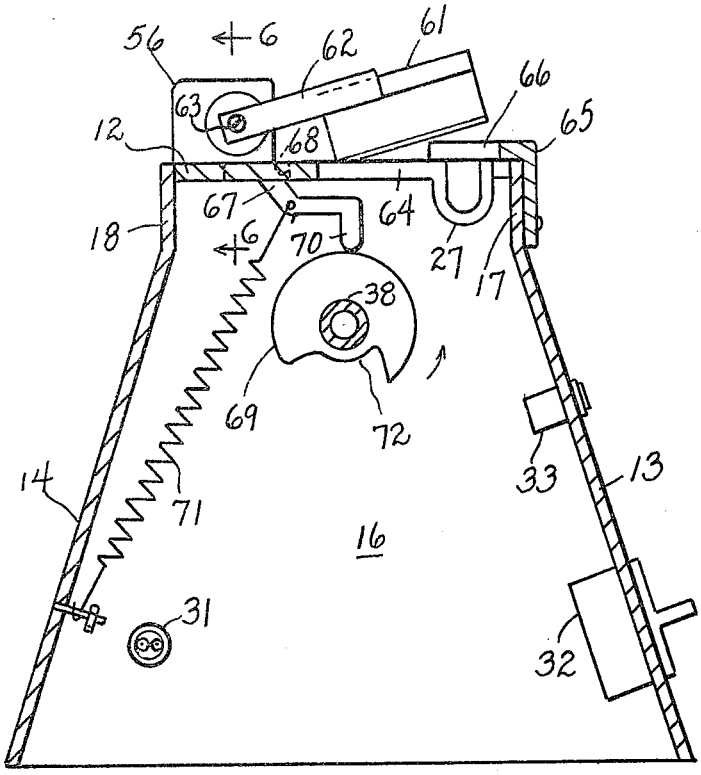
FIG. 5 is a transverse vertical cross-sectional view taken substantially on line 5—5 of FIG. 1.

As shown in FIG. 4, the gear teeth of the respective gears 44, 45, 46 terminate at the same phase position with respect to their rotary axis, said phase position being indicated at 55 (assuming counterclockwise rotation of hollow shaft 38, as viewed in FIG. 5), so that the dwell periods begin substantially at the same phase position of shaft 38 regardless of which slice thickness is selected. As will be pointed out below, this enables the use of a single cutter control cam for any of the selected slice thicknesses.

Figure 6:
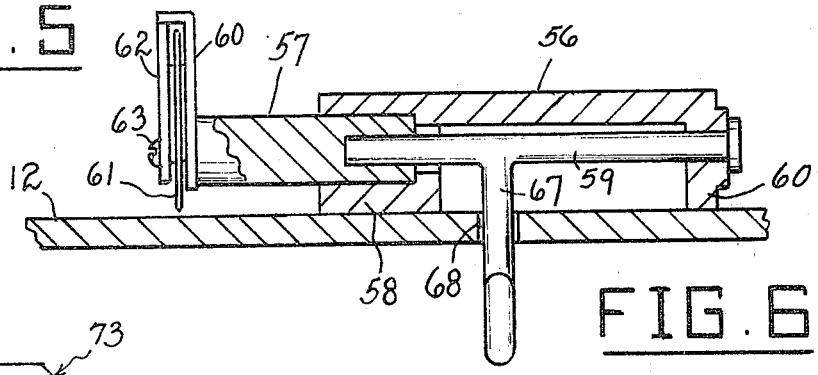
FIG. 6 is an enlarged fragmentary longitudinal vertical cross-sectional view taken substantially on line 6—6 of FIG. 5.

Mounted on top wall 12 is a longitudinally extending elongated housing 56 spaced rightwardly from the feed screw bearing block 21, as viewed in FIG. 1, and located near the rear longitudinal vertical wall element 18. As shown in FIG. 6, a relatively large-diameter longitudinal shaft member 57 is journalled in the left end wall portion 58 of housing 56. A smaller-diameter longitudinal shaft member 59 is rotatably and retentively engaged in the right end wall 60 and is rigidly axially secured to shaft member 57. At its outer end, said shaft member 57 is provided with a perpendicularly extending arm 60 recessed to receive a single-edge razor blade 61 which is tightly secured therein by means of a clamping bar 62 held in clamping position by a clamping screw 63. Top wall 12 and trough 27 are formed with a transverse cutting slot 64 vertically aligned with razor blade 61, as shown in FIG. 5. A removable right-angled cutter guide bracket 65 is rigidly secured on vertical wall elements 17 and is formed with a cutter guide slot 66 extending over trough 27 and being vertically aligned with slot 64.

Shaft 59 is provided with a perpendicularly extending arm 67 which passes through a transverse slot 68 formed in top wall 12. A cam 69 is mounted on hollow shaft 38 in the transverse vertical plane containing arm 67. Said arm 67 is formed at its free end portion with a depending follower lug 70 coplanar with and engageable on the periphery of cam 69. Lug 70 is biased into engagement with cam 69 by a coiled spring 71 connected between the intermediate portion of arm 67 and the lower portion of rear wall 14, as shown in FIG. 5. Cam 69 is formed with a cutter release notch 72, located to release arm 67 soon after the commencement of the feed screw dwell period.

Normally, lug 70 engages with the generally circular peripheral portion of cam 69 and holds the blade 61 in the elevated position thereof shown in FIG. 5. Shortly after the commencement of the feed screw dwell period, lug 70 is allowed to abruptly drop into notch 72, allowing spring 71 to drive blade 61 downwardly through a chopping stroke, thereby performing a gel-slicing operation. The notch 72 is shorter in angular length than the angular length corresponding to the minimum dwell period of feed screw 19. Thus, before the termination of said feed screw dwell period the lug 70 is elevated out of notch 72 and raises blade 61 to its normal elevated position.

Figure 7:
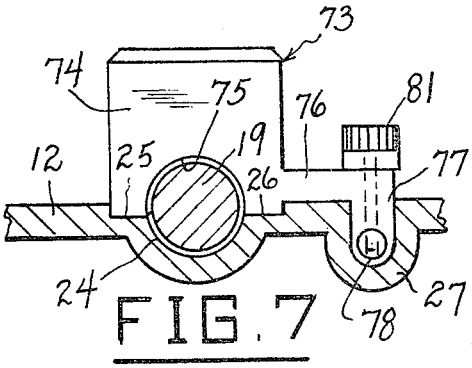
FIG. 7 is an enlarged side elevational view of the gel-advancing feed plunger assembly employed in the gel slicer of FIG. 1, taken substantially on line 7—7 of FIG. 1.
Figure 8:
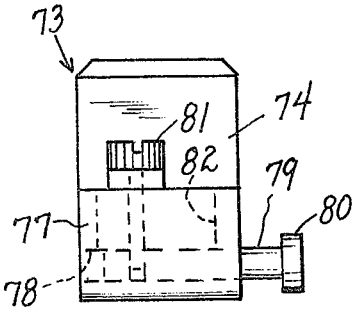
FIG. 8 is an enlarged front elevational view of the feed plunger assembly employed in the gel slicer of FIG. 1.

Designated at 73 is a manually settable plunger assembly comprising a relatively heavy block 74 formed on its bottom with half-threads 75 threadedly engageable on the feed screw 19. The bottom of the block 74 is shaped to slidably interfit with the guide recesses 25, 26 on opposite sides of the screw 19, as shown in FIG. 7. The block 74 has a laterally extending bottom flange 76 provided with a depending outer subflange 77 slidably and conformably engageable in the trough 27. The bottom end of subflange 77 is formed with a longitudinal bore 78 containing a longitudinally adjustable shank member 79 provided with an abutment head 80 (see FIG. 8). A clamping screw 81 extends through a longitudinal slot 82 in subflange 77 and is threadedly engaged with shank 79 to lock the abutment head 80 in an adjusted position relative to the adjacent side edge of subflange 77.

The plunger assembly 73 may be manually disposed in threaded engagement with feed screw 19 at a selected starting position behind the gel material to be sliced, whereby the feed trough 24 can receive different lengths of such gel material and the plunger assembly 73 may be set to advance any of such lengths for immediate slicing after the material has been placed in the feed trough.

As above explained, in the typical embodiment herein described, any one of three gel segments can be obtained having thicknesses of 1 mm, 1.5 mm and 2 mm, respectively. These segment thicknesses are selected by means of the 3-position knob 49 which controls the horizontal position of the shaft 41 on which the three circular gears 44, 45 and 46 are mounted. Each one of the three gear discs has a precise number of teeth along its circumference, which number is different on each gear disc. Thus, the "tooth length" on each gear disc determines the thickness of the gel slice obtained therewith. Gels are sliced by the action of the single-edge razor blade 61, which cuts completely through the gel and operates with a chopping action (similar to a microtome apparatus which is used to provide thin tissue slices for electron microscopy). Following each chop, the razor blade 61 is lifted on the cam 69, which rotates continuously, and the gel is pushed along the trough 27 by the plunger abutment head 80 in incremental steps. These incremental steps are automatically preset by the tooth configurations on the three gear discs in the circular gear assembly. Thus, the longitudinal stepping motion of the gel is synchronized with the rise and fall of the razor blade 61.

In operation, a length of gel material is placed in the trough 27 and a few drops of water (or aqueous buffer) are added to provide some lubrication. The plunger assembly 73 is then placed on the feed screw 19 at a position such that the distance between the plunger assembly and the razor blade is somewhat greater than the length of the gel material. The desired slice thickness is then selected by means of the knob 49 and the motor 30 is then started by means of the main switch 32. After the whole length of the gel material is sliced, each gel segment may be recovered from the trough 27, one segment at a time. The slices can be removed through the end of the trough by rotating the end cover disc 29 to open position relative to the trough, allowing the slices to be pushed out of the trough.

The dwell period of the feed screw 19 will vary, depending upon which of the gears 44, 45 or 46 is selected to drive the feed screw. The 2 mm slice thickness drive gear 44 will provide the shortest dwell period, since gear 44 has the most gear teeth and the shortest toothless peripheral length. The cam notch 72 is designed to re-elevate the blade 61 before the termination of said shortest dwell period, namely, before shaft 41 has rotated through an angle corresponding to the blank portion of the periphery of gear 44.

While a specific embodiment of an improved electrically driven gel slicer has been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiment.

What is claimed is:

1. A gel slicer comprising a support formed with a gel guide trough; a feed screw journalled on said support parallel to said trough; feed plunger means threadedly engaged on said feed screw and having a plunger portion engaged in the trough;

drive means to intermittently drive the feed screw and to define a predetermined dwell period between driving periods of said feed screw, said drive means including a motor, a continuously driven shaft, and control means to effect said intermittent driving of said feed screw followed in sequence by a period during which said feed screw is not driven;

transverse cutting blade means pivoted on said support adjacent said trough, means normally maintaining said blade means elevated relative to said trough, and means to drive said blade means downwardly through the trough at a predetermined time following the initiation of a dwell period of said feed screw, said means to drive the blade means downwardly comprising biasing means urging said blade means downwardly and cam means normally maintaining said blade means elevated and having means to release said blade means at said predetermined time following the initiation of said dwell period.

2. The gel slicer of claim 1, and wherein said control means includes motor means and gear train means between said said feed screw, said gear train means including a driven gear coupled to the feed screw and a drive gear coupled to said motor means and having peripheral teeth arranged to mesh with said driven gear and having a toothless peripheral portion defining said dwell period.

3. The gel slicer of claim 2, and wherein said feed plunger means comprises a weighted block member having half-threads drivingly engaged on said feed screw, said plunger portion being laterally spaced from said weighted block member.

4. The gel slicer of claim 3, and wherein said plunger portion is provided with a longitudinally adjustable head element projecting forwardly into the trough.

5. The gel slicer of claim 2, and wherein said biasing means comprises spring means connected between the blade means and the support to urge the blade means downwardly, said cam means being on said driven shaft means, and follower means connected to said blade means and engaging said cam means.

6. The gel slicer of claim 5, and wherein said cam means is shaped to re-elevate said blade means at a predetermined time prior to the expiration of said dwell period.

7. The gel slicer of claim 2, and wherein said feed plunger means is formed with bottom half-threads drivingly engageable with said feed screw, whereby the feed plunger means can be drivingly positioned on the feed screw at any selected location along the feed screw by manually lowering the feed plunger means onto the feed screw.

8. The gel slicer of claim 7, and wherein said support is formed with longitudinal guide track means adjacent the feed screw, said feed plunger means being formed to slidably interfit with said guide track means.

9. A gel slicer comprising a support formed with a gel guide trough, a feed screw journalled on said support parallel to said trough, feed plunger means threadedly engaged on said feed screw and having a plunger portion engaged in the trough, means to drive the feed screw intermittently and to define a predetermined dwell period between driving periods of said feed screw, transverse cutting blade means provided on said support adjacent said trough, means normally maintaining said blade means elevated relative to said trough, and means to drive said blade means downwardly through the trough at a predetermined time following the initiation of a a dwell period of said feed screw, and wherein said drive means to drive the feed screw intermittently includes motor means and gear train means between said motor means and said feed screw, said gear train means including a driven gear coupled to the feed screw and a plurality of drive gears coupled to said motor means and respectively having peripheral teeth of different number arranged at times to mesh with said driven gear and having toothless peripheral portions defining dwell periods of the feed screw, and means to selectively couple the drive gears to said driven gear.

10. The gel slicer of claim 9, and wherein the means to drive the blade means downwardly comprises biasing means urging said blade means downwardly and cam means normally maintaining said blade means elevated and having means to release said blade means at said predetermined time following the initiation of said dwell period and to re-elevate said blade means prior to the expiration of the minimum dwell period defined by the toothless peripheral portions of the drive gears.

11. A gel slicer comprising a support formed with a gel guide trough, a feed screw journalled on said support parallel to said trough, feed plunger means threadedly engaged on said feed screw and having a plunger portion engaged in the trough, means to drive the feed screw intermittently and to define a predetermined dwell period between driving periods of said feed screw, transverse cutting blade means pivoted on said support adjacent said trough, means normally maintaining said blade means elevated relative to said trough, and means to drive said blade means downwardly through the trough at a predetermined time following the initiation of a dwell period of said feed screw, wherein the means to drive the blade means downwardly comprises spring means connected between the blade means and the support to urge the blade means downwardly, motor means, drive shaft means coupled to said motor means, cam means on said drive shaft means, and follower means connected to said blade means and engaging said cam means, said cam means being shaped to normally maintain the blade means elevated and to release the blade means at said predetermined time following the initiation of said dwell period, and wherein said feed screw drive means includes gear train means between said motor means and said feed screw, said gear train means including a driven gear coupled to the feed screw and a plurality of drive gears coupled to said motor means and respectively having different numbers of teeth and having blank peripheral portions defining dwell periods of the feed screw, and means to selectively couple the drive gears to said driven gear.

12. The gel slicer of claim 11, and wherein said feed screw drive means includes a splined shaft portion driven by said motor means, a driven shaft element, said drive gears being mounted side-by-side on said driven shaft element, and means to slidably key said driven shaft element to said splined shaft portion, and wherein the means to selectively couple the drive gears to the driven gear comprises means to axially move said driven shaft element.

13. The gel slicer of claim 11, and wherein the peripheral gear teeth commence at substantially the same phase location on the drive gears.

14. The gel slicer of claim 13, and wherein said cam means is shaped to re-elevate said blade means prior to the expiration of the dwell period defined by the drive gear having the shortest blank peripheral portion.

* * * * *

UNITED STATES PATENT AND TRADEMARK OFFICE

CERTIFICATE OF CORRECTION

PATENT NO. : 4,331,054

DATED : May 25, 1982

INVENTOR(S) : WILLIAMS, Vincent P. et al

It is certified that error appears in the above–identified patent and that said Letters Patent are hereby corrected as shown below:

Claim 2, line 2, delete "motor means and"

line 3, after "said" (1st occurrence)

insert --motor means and--.

Signed and Sealed this

*Twelfth* Day of *October 1982*

[SEAL]

*Attest:*

GERALD J. MOSSINGHOFF

*Attesting Officer*

*Commissioner of Patents and Trademarks*